US007140887B2

(12) United States Patent
Poh et al.

(10) Patent No.: US 7,140,887 B2
(45) **Date of Patent: *Nov. 28, 2006**

(54) ELECTRICAL WIRING DEVICE WITH MULTIPLE TYPES OF WIRE TERMINATIONS

(75) Inventors: Patrick Poh, East Northport, NY (US); Juan M. Lopez, Jamaica, NY (US)

(73) Assignee: Leviton Manufacturing Co., Inc., Little Neck, NY (US)

( * ) Notice: Subject to any disclaimer, the term of this patent is extended or adjusted under 35 U.S.C. 154(b) by 0 days.

This patent is subject to a terminal disclaimer.

(21) Appl. No.: 11/121,886

(22) Filed: May 4, 2005

(65) Prior Publication Data

US 2005/0202712 A1 Sep. 15, 2005

Related U.S. Application Data

(63) Continuation of application No. 09/952,098, filed on Sep. 15, 2001, now Pat. No. 6,926,543, which is a continuation of application No. 09/426,458, filed on Oct. 25, 1999, now abandoned.

(51) Int. Cl.
*H01R 13/648* (2006.01)

(52) U.S. Cl. ..... 439/107

(58) Field of Classification Search ..... 439/107, 439/441, 106, 650, 535; 174/53; 200/297
See application file for complete search history.

(56) References Cited

U.S. PATENT DOCUMENTS 3,689,870 A * 9/1972 Jaconette ..... 439/752
3,694,790 A * 9/1972 Martin ..... 439/107
3,944,314 A * 3/1976 Weitzman et al. ..... 439/411
4,097,112 A * 6/1978 Veldman et al. ..... 439/782
4,172,628 A * 10/1979 Lingaraju ..... 439/441
4,392,707 A * 7/1983 Holce et al. ..... 439/573
4,422,701 A * 12/1983 Anderson ..... 439/107
5,472,350 A * 12/1995 Mehta ..... 439/107
6,109,937 A * 8/2000 Bonilla et al. ..... 439/107

* cited by examiner

*Primary Examiner*—Chandrika Prasad
(74) *Attorney, Agent, or Firm*—Paul J. Sutton

(57) ABSTRACT

A wiring device is provided with three different ways in which the bared end of an electrical conductor can be coupled to the contacts inside the body of a wiring device. A clamping plate is placed upon the threaded body of a terminal screw. In a first arrangement the bared end is formed about the terminal screw and trapped between the head of the terminal screw and a first surface of the clamping plate which forces the conductor into firm contact with the first surface of the clamping plate. In another arrangement the straight bared end of the conductor is trapped between a second surface of the clamping plate and a contact plate. The movement of the conductor and clamping plate is controlled by the terminal screw. Apertures are placed in the bottom of the device housing adjacement the contacts in the housing. A contact arm, formed as a one-way clutch grips the straight bared end of a conductor to make contact with the contacts of the device but prevents withdrawal of the conductor.

4 Claims, 4 Drawing Sheets

50
32
28
12
64
62

ELECTRICAL WIRING DEVICE WITH MULTIPLE TYPES OF WIRE TERMINATIONS

The present application claims priority from, and is a continuation of, application Ser. No. 09/952,098 filed Sep. 15, 2001, now U.S. Pat. No. 6,926,543, which is a continuation of parent application Ser. No. 09/426,458 filed Oct. 25, 1999, now abandoned.

BACKGROUND OF THE INVENTION

1. Field of the Invention

The instant invention is directed to the field of wiring devices and more particularly to wiring devices having multiple means to connect electrical conductors to such wiring devices.

2. Description of the Prior Art

Prior art devices have terminal screws which permit the bared end of an electrical conductor to be placed under the head of such terminal screw or push-in sections which allow the bared end of an electrical conductor to be inserted therein or a combination of a terminal screw and clamping plate which traps the bared end of an electrical conductor between a clamping plate and a contact pad of a wiring device. Although some of these approaches can be combined in one wiring device none are available which offer all three conductor to wiring device techniques.

SUMMARY OF THE INVENTION

The instant invention provides a wiring device which provides all three of the above-described electrical conductor to wiring device wiring techniques. The wiring device has a number of contact pads, one for each contact of the wiring device. The surface of the contact pad is scored to permit it to better grip the bared end of an electrical conductor. A threaded aperture in the contact pad threadingly engages a threaded terminal screw. The bared end of an electrical conductor can be bent into a u-shape and placed about the threaded portion of the terminal screw and is engaged by the backside of the terminal screw head and front surface of a clamping plate. The u-shaped conductor can be closed into a circular shape before the terminal screw is tightened. A clamping plate is positioned on the terminal screw and is moved by the terminal screw towards the contact pad to trap the straight, bared end of an electrical conductor between the clamping plate and the contact pad. An aperture is provided in the bottom of the wiring device housing at each contact of the wiring device and partially blocked by the free end of a spring member formed as a one-way clutch. The bared end of an electrical conductor can be inserted in an aperture to displace the free end of the spring member. Any attempted withdrawal of the conductor forces the end of the spring member to bite into the conductor and prevent its withdrawal. It is an object of this invention to provide an improved wiring device.

It is an object of this invention to provide a novel wiring device which permits electrical conductors to be coupled thereto using three coupling means.

Other objects and features of the invention will be pointed out in the following description and claims and illustrated in the accompanying drawings, which disclose, by way of example, the principles of the invention, and the best mode which is presently contemplated for carrying them out.

BRIEF DESCRIPTION OF THE DRAWING

In the drawings in which similar elements are given similar reference characters.

DESCRIPTION OF THE PREFERRED EMBODIMENT

Figure 1:
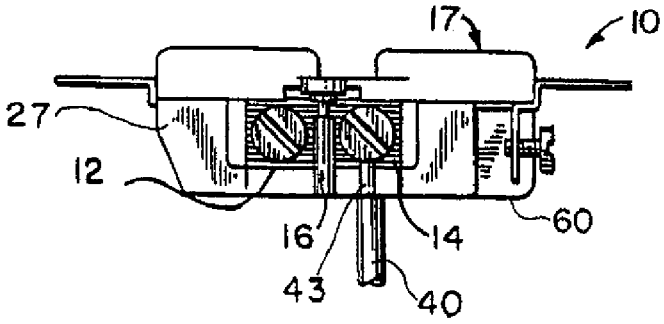
FIG. 1 is a front elevational view of a wiring device.
Figure 2:
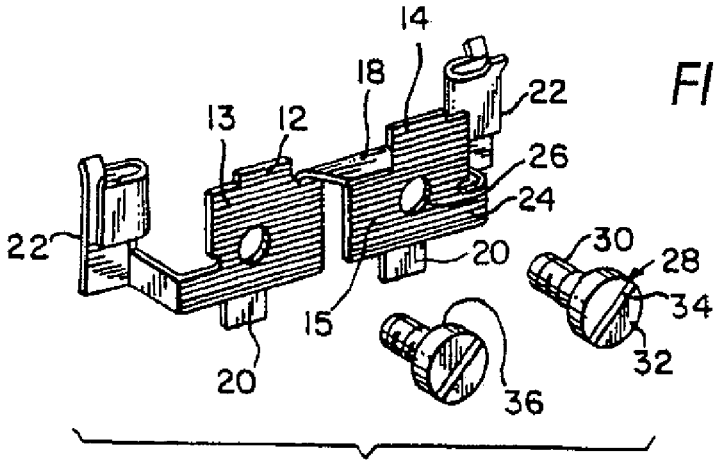
FIG. 2 is an exploded perspective view of the contact pads and terminal screws of the device of FIG. 1.
Figure 7:
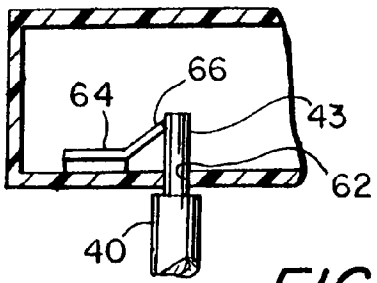
FIG. 7 is a fragmentary, partly in section, portion of the wiring device of FIG. 1.
Figure 6:
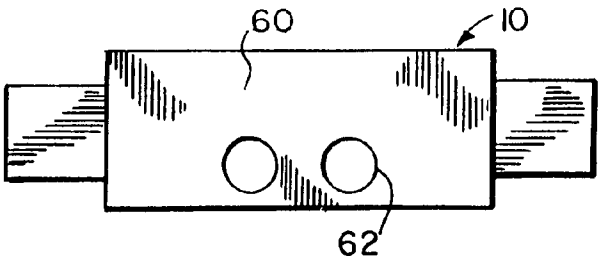
FIG. 6 is a bottom plan view of the wiring device of FIG. 1.
Figure 8:
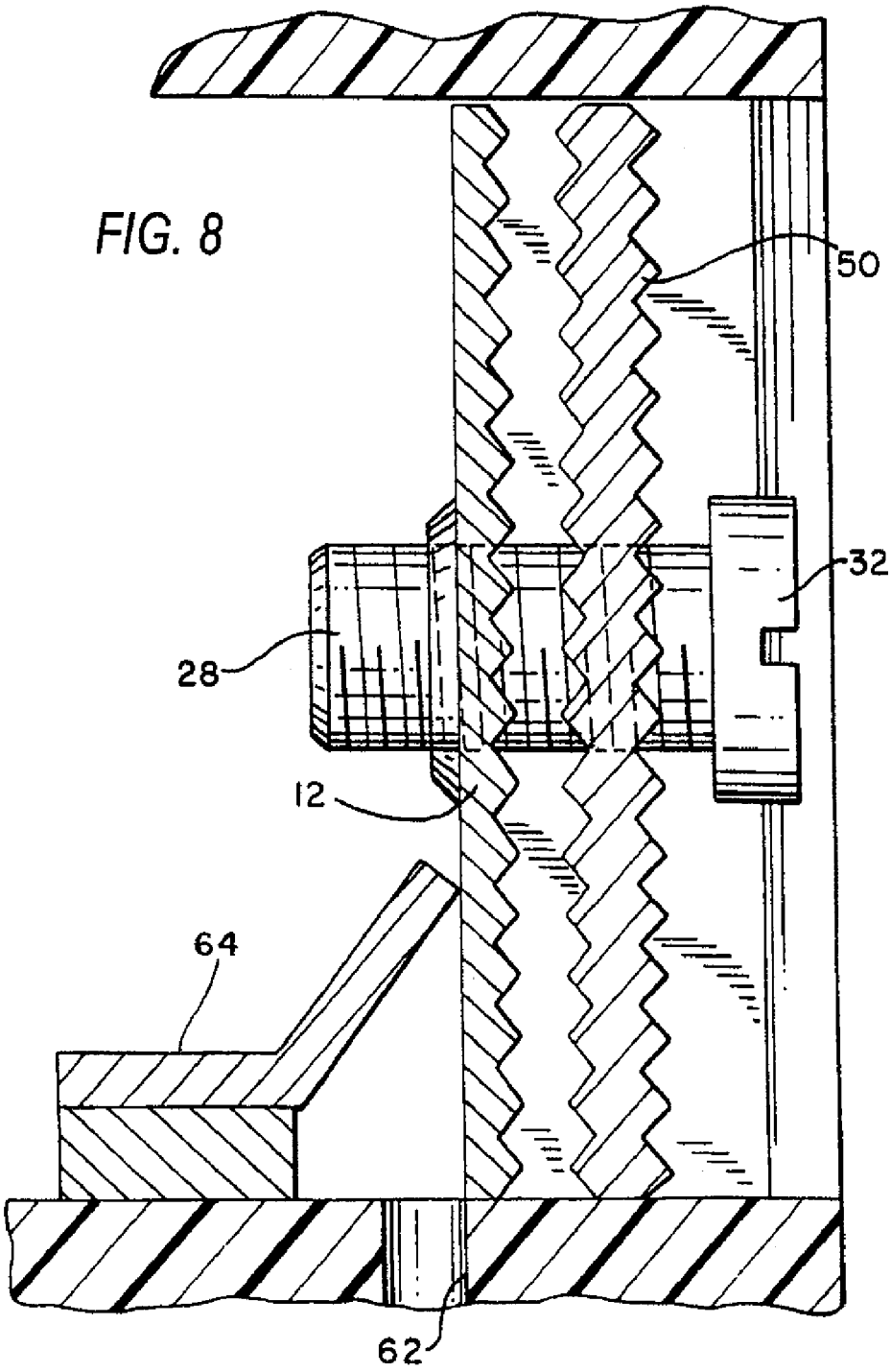
FIG. 8 shows the clamping plates mounted in a recess in the side of the wiring device and a spring contact electrically coupled to a contact pad.

Turning to FIGS. 1 and 2 there is shown a wiring device 10 which may be a receptacle, switch or the like. The wiring device 10 includes a body 17 having side surface 27 and having a bottom surface 60 with aperture 62 therethrough, as shown in FIGS. 6 and 7. Two contact pads 12 and 14 which fit in a recess within the side of the body of wiring device 10 arc exposed to receive a bared end 43 of a conductor 40. A barrier 16 of insulating material is positioned so that the barrier 16 separates the contact pads 12 and 14 and is employed when the contact pads 12 and 14 are separately wired. A bridge 18 of metal joins the contact pads 12 and 14 if the circuits are wired in common, and may be removed when the circuits are to be separately wired. Tabs 20 and side wings 22 are employed as anchor elements to anchor the contact pads 12 and 14 in place in the body 17 of the wiring device 10. Each of front faces 13 and 15, respectively, of the contact pads 12 and 14 are serrated as at 24 to better grip a conductor placed thereon. Further, each of the contact pads 12,14 has a threaded aperture 26 therein-to threadably engage the threaded portion 30 of a terminal screw 28. The terminal screw 28 has a head 32 which includes a slot 34 to receive a screw driver to tighten or loosen the terminal screw 28. The underside 36 of head 32 is made to bear on a conductor or a clamping plate as will be described below.

Figure 3:
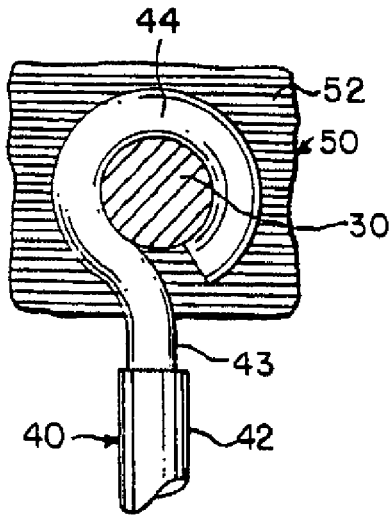
FIG. 3 is a front elevational view of the front surface of a clamping plate showing the bared end of an electrical conductor wrapped about a portion of a terminal screw, shown in section.

In a first way to attach a conductor 40 to a wiring device, the insulation 42 is stripped from one end of conductor 40 and the bared conductor 43 is generally bent into a u-shaped loop 44. Once it is placed about the threaded portion 30 of terminal screw 28 the u-shaped loop 44 may be further bent about threaded portion 30 to form a near full circle as shown in FIG. 3. The loop 44 is positioned between the serrated front face 52 of clamping plate 50 and the underside 36 of the terminal screw head 32. The terminal screw 28 is now advanced until the clamping plate 50 is in contact with the contact pad 12 and the loop 44 is trapped between the serrated front surface 52 of clamping plate 50 and the underside 36 of the terminal screw head 32.

Figure 5:
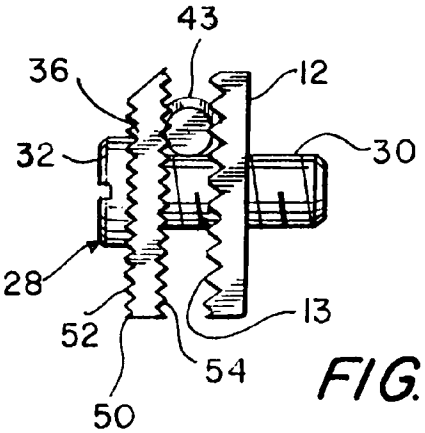
FIG. 5 is a side elevational view of the components of FIG. 4 assembled.
Figure 4:
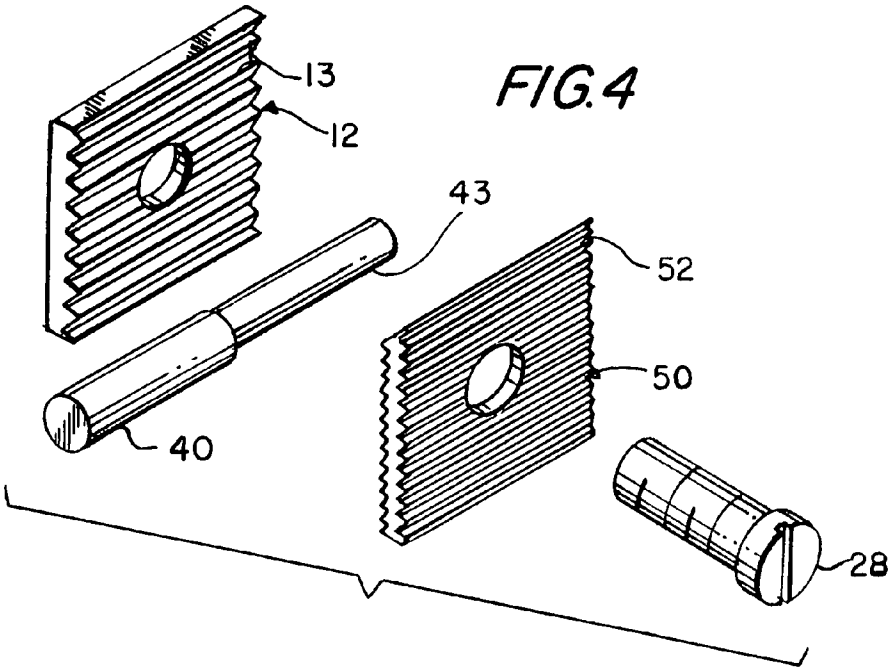
FIG. 4 is an exploded view of the contact pad of FIG. 2 with a clamping plate positioned between a terminal screw head and a contact pad.
Figure 9:
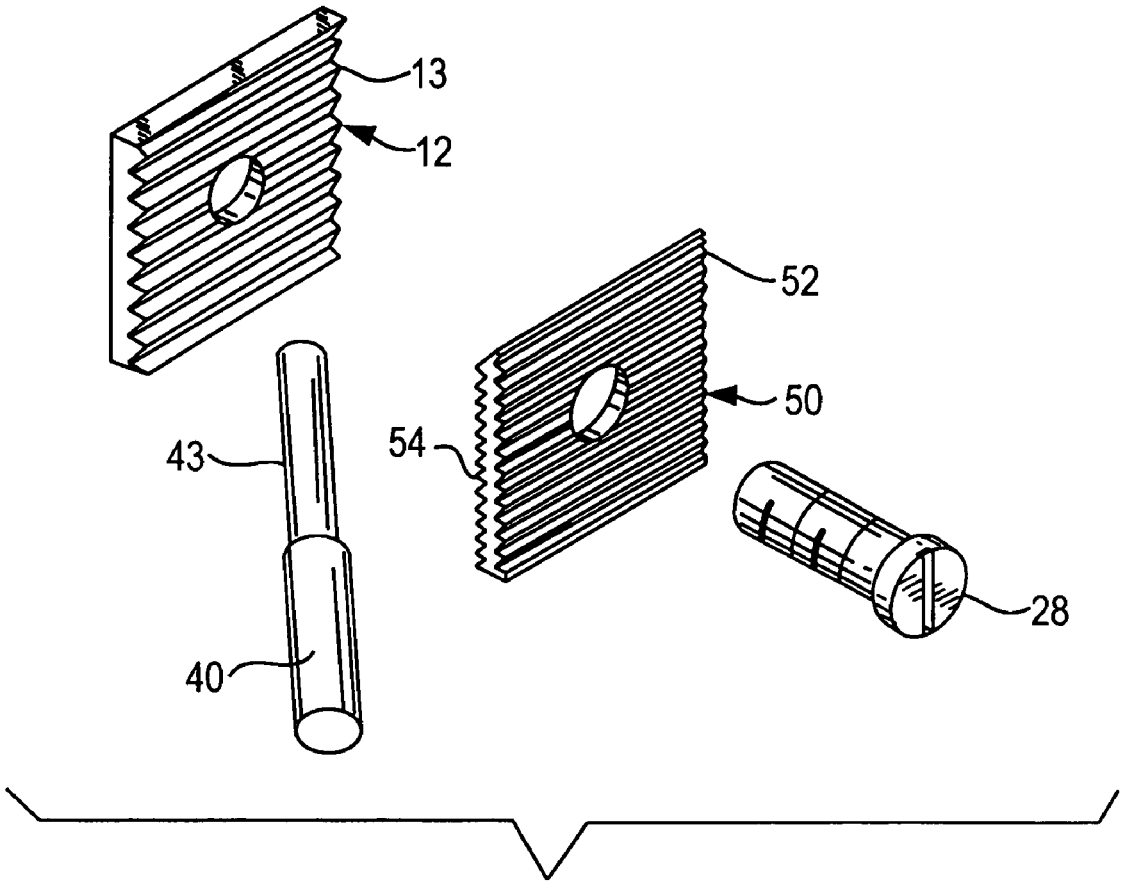
FIG. 9 is an exploded view of the contact pad of FIG. 2 with a clamping plate positioned between a terminal screw and a contact pad.

A second way in which the bared end 43 of an electrical conductor 40 can be attached to wiring device 10 is by trapping the bared end 43 of the electrical conductor 40 between the serrated rear face 54 of clamping plate 50 and the serrated front face 13 of the contact pad 12 as shown in FIGS. 4, 5 and 9. As shown in FIGS. 4, 5 and 9, the clamping plate 50 has serrations on the front and rear surfaces that are of equal number per inch and grater than the number of serrations per inch on the front face of contact pad 12. The bared end 43 of the conductor 40 is placed on the serrated front face 13 of contact pad 12 and the terminal screw 28 is advanced. The underside 36 of the had 32 bears on the front face 52 of clamping plate 50 and moves the clamping plate 50 towards the contact pad 12. Upon sufficient tightening of the terminal screw 28, the bared end 43 of the electrical conductor 40 is held between the serrated rear face 54 of clamp plate 50 and the serrated front face 13 of the contact pad 12. The bared end is at an angle to the serrations, either straight or at some other angle as shown schematically in FIGS. 4 and 9 respectively. The operation of a clamping plate with contact 14 is the same as described with respect to contact pad 12.

While there have been shown and described and pointed out the fundamental novel features of the invention as applied to the presently preferred embodiment, it will be understood that various omissions and substitutions and changes of the form and details of the device illustrated and in its operation may be made by those skilled in the art, without departing from the spirit of the invention.

We claim:

1. An electrical wiring device with at least four types of wire terminations located in a body having side surfaces and a bottom surface, the electrical wiring device comprising:

a first contact pad mounted in a recess in a side surface and a second contact pad mounted in a recess in the side surface, each contact pad being electrically isolated from each other, each contact pad being exposed, and each contact pad having a front surface, and each contact pad having a threaded aperture therethrough;

a plurality of clamping plates, each clamping plate associated with a respective terminal fastener having a head and a threaded body extending therefrom, each clamping plate associated with a respective contact pad and having a front surface and a rear surface, wherein at least one of the rear or the front surfaces has a plurality of serrations capable of engaging a conductor, wherein each clamping plate is positioned on the threaded body of a respective associated terminal fastener to permit the rear surface of the respective clamping plate to be moved towards the front surface of a respective associated contact pad to permit the bared end of a conductor to be bent and placed about the threaded body of a terminal fastener and positioned intermediate the head of a terminal fastener and the front surface of its associated clamping plate to provide a first type of wire termination, or remain straight and be positioned intermediate the rear surface of a clamping plate and an associated contact pad and at an angle to the plurality of serrations to provide a second type of wire termination;

first and second apertures located through the bottom surface of the electrical wiring device wherein the first aperture is associated with the first contact pad and the second aperture is associated with the second contact pad;

a spring contact mounted proximate to each aperture through the bottom surface of the body and electrically coupled to each contact pad wherein an end of the spring contact electrically communicates with the bared end of a conductor inserted through the aperture to thereby electrically couple the conductor to the electrical wiring device, wherein the spring contact provides a third type of wire termination independent of the clamping plate or the contact pad; and a ground terminal which provides a fourth type of wire termination, wherein the ground terminal electrically communicates with a mounting strap and is associated with a fastener capable of holding a ground conductor in electrical communication with said strap.

2. The electrical wiring device of claim 1, wherein each spring contact prevents the withdrawal of a conductor from a respective aperture.

3. The electrical wiring device of claim 1, further comprising:

a bridge for electrically coupling the first contact pad and the second contact pad.

4. The electrical wiring device of claim 1, wherein each clamping plate is substantially rectangular.

* * * * *

UNITED STATES PATENT AND TRADEMARK OFFICE

CERTIFICATE OF CORRECTION

PATENT NO. : 7,140,887 B2
APPLICATION NO. : 11/121886
DATED : November 28, 2006
INVENTOR(S) : Patrick Poh and Juan M. Lopez It is certified that error appears in the above-identified patent and that said Letters Patent is hereby corrected as shown below:

Column 2 line 37, “arc” should read -- are --.

Column 3 line 8, “grater” should read -- greater --.

Signed and Sealed this

Twenty-sixth Day of August, 2008

JON W. DUDAS
*Director of the United States Patent and Trademark Office*